US009851695B1

(12) United States Patent
Roth et al.

(10) Patent No.: US 9,851,695 B1
(45) Date of Patent: Dec. 26, 2017

(54) WATCH BEZEL ASSEMBLY

(71) Applicants: Geoffrey H. H. Roth, Sedona, AZ (US); Andrew Farr Archibald, Scottsdale, AZ (US)

(72) Inventors: Geoffrey H. H. Roth, Sedona, AZ (US); Andrew Farr Archibald, Scottsdale, AZ (US)

( * ) Notice: Subject to any disclaimer, the term of this patent is extended or adjusted under 35 U.S.C. 154(b) by 0 days.

(21) Appl. No.: 15/350,914

(22) Filed: Nov. 14, 2016

(51) Int. Cl.
*G04B 19/28* (2006.01)

(52) U.S. Cl.
CPC ..... *G04B 19/283* (2013.01); *G04B 19/286* (2013.01)

(58) Field of Classification Search
CPC ..... G04G 9/042; G04G 9/045; G04G 9/047; G04B 5/06; G04B 19/28; G04B 19/286
See application file for complete search history.

(56) References Cited

U.S. PATENT DOCUMENTS

| | | | | |
|---|---|---|---|---|
| 2,948,173 | A * | 8/1960 | Herrmann | B25B 23/141 464/36 |
| 5,319,617 | A | 6/1994 | Sonoda | |
| 5,746,298 | A * | 5/1998 | Krivec | B25B 15/02 192/48.3 |
| 7,490,978 | B2 | 2/2009 | Crisci | |
| 8,448,767 | B2 * | 5/2013 | Ando | F16D 41/066 192/45.006 |
| 9,400,488 | B2 * | 7/2016 | Marechal | G04B 5/12 |
| 2008/0117723 | A1 | 5/2008 | Hiranuma et al. | |
| 2009/0306717 | A1 * | 12/2009 | Kercher | A61B 17/7011 606/258 |
| 2010/0220560 | A1 | 9/2010 | Hiranuma et al. | |
| 2013/0201804 | A1 * | 8/2013 | Bertrand | G04B 19/283 368/281 |
| 2013/0345801 | A1 * | 12/2013 | Conklin | A61F 2/2496 623/2.11 |
| 2015/0227113 | A1 | 8/2015 | Cattaneo et al. | |
| 2016/0151895 | A1 * | 6/2016 | Markiewicz | B25B 23/141 81/474 |
| 2016/0185417 | A1 * | 6/2016 | Tang | B62K 3/002 280/205 |

FOREIGN PATENT DOCUMENTS

| | | |
|---|---|---|
| CH | 626493 | 11/1981 |
| CN | 201269973 | 7/2009 |
| EP | 0216420 | 4/1987 |
| EP | 0573386 | 12/1993 |
| EP | WO1997045775 | 12/1997 |
| FR | 2548797 | 1/1985 |

OTHER PUBLICATIONS

Seiko 7002-7000 http://thewatchspotblog.com/?p=168.

* cited by examiner

*Primary Examiner* — Sean Kayes
(74) *Attorney, Agent, or Firm* — Weiss & Moy, P.C.; Jeffrey D. Moy; Veronica-Adele R. Cao

(57) ABSTRACT

A bezel assembly for a watch wherein a plurality of resilient devices, such as springs or balls, are positioned within a plurality of ramps within the case. A plurality of rod end screws are also inserted through a plurality of corresponding apertures of the bezel and into the case in order to prevent the bezel from rising up from the case when the balls are pushed up the ramps by the resilient devices. As the bezel is turned in a clockwise direction, the resilient devices exert pressure upon the balls in an upward direction toward and against the bezel so that the bezel is prevented from moving in the clockwise direction.

20 Claims, 9 Drawing Sheets

WATCH BEZEL ASSEMBLY

FIELD OF THE INVENTION

The present invention generally relates to watches, and more specifically, to a watch bezel assembly.

BACKGROUND OF THE INVENTION

A typical watch may have a bezel; i.e. a ring around the case. Two types of bezels are commonly used; timing bezels and diving bezels. Timing bezels move in both clockwise and counter-clockwise directions while diving bezels, which are used to visually keep track of a diver's air supply by measuring dive time, only rotate in the counter-clockwise direction. Other bezels may be purely aesthetic and may not move in either direction.

Traditional diving bezels, however, still allow for some movement of the bezel in the clockwise direction, thus causing inaccurate readings for the user. For example, the marking on the bezel may be pointing at "12" on the watch dial, in order to indicate that the user began their dive at the top of the hour. As the diver descends, an object impacting the bezel may cause the bezel to move in the clockwise direction and to point slightly to the right of "12." The user may then believe that he began the dive at one or two minutes past the hour. For a diver who has a finite supply of air, the one or two minute discrepancy can be fatal. For safety reasons, it is crucial to provide the user with the most accurate measurements for dive time as possible.

The present invention provides a watch bezel assembly having a bezel that uses a resilient device, such as a spring or bumper, positioned within a channel formed in the case to keep constant pressure on the ball and to cause the instantaneous stoppage of the bezel if moved in a clockwise direction. A plurality of rod end screws are also inserted through a plurality of corresponding apertures of the bezel and into the case in order to prevent the bezel from rising up from the case when the balls are pushed up the ramps by the resilient devices. The instantaneous stoppage of the bezel prevents any movement of the bezel in the clockwise direction, thereby allowing for precise readings for the user.

SUMMARY

In accordance with one embodiment of the present invention, a bezel assembly for a watch is disclosed. The bezel assembly comprises a case; a bezel adapted to be coupled to the case; and a plurality of locking mechanisms between the case and the bezel, wherein each locking mechanism comprises: a ramp; a ball contained within the ramp; and a resilient device positioned within the ramp; wherein the resilient device exerts a constant pressure upon the ball to prevent the bezel from moving in a clockwise direction relative to the case.

In accordance with another embodiment of the present invention, a bezel assembly for a watch is disclosed. The bezel assembly comprises: a case, wherein the case comprises: a base; and a cylindrical body extending upwardly from the base; a bezel adapted to be coupled to the case; and a plurality of locking mechanisms between the case and the bezel, wherein each locking mechanism comprises: a ramp having a first end and a second end; a ball contained within the ramp; and one of a spring and a bumper positioned within the ramp and coupled to the first end of the ramp; wherein the one of the spring and the bumper exerts a constant pressure upon the ball to prevent the bezel from moving in a clockwise direction relative to the case.

In accordance with another embodiment of the present invention, a bezel assembly for a watch is disclosed. The bezel assembly comprise: a case, wherein the case comprises: a base; a cylindrical body extending upwardly from the base; and a cylindrical track formed within an outer surface of the cylindrical body; a bezel adapted to be coupled to the case, wherein the bezel comprises: a plurality of apertures formed within an outer surface of the bezel and that pass through to an inner surface of the bezel; and a plurality of screws, each screw having a rod end that is adapted to be inserted through one of the apertures of the bezel and to engage the circular track formed within the outer surface of the cylindrical body; and a plurality of locking mechanisms between the case and the bezel, wherein each locking mechanism comprises: a ramp having a first end and a second end; a ball contained within the ramp; and one of a spring and a bumper positioned within the ramp and coupled to the first end of the ramp; wherein the one of the spring and the bumper exerts a constant pressure upon the ball to prevent the bezel from moving in a clockwise direction relative to the case while the screws prevent the bezel from moving upwards.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

Figure 1:
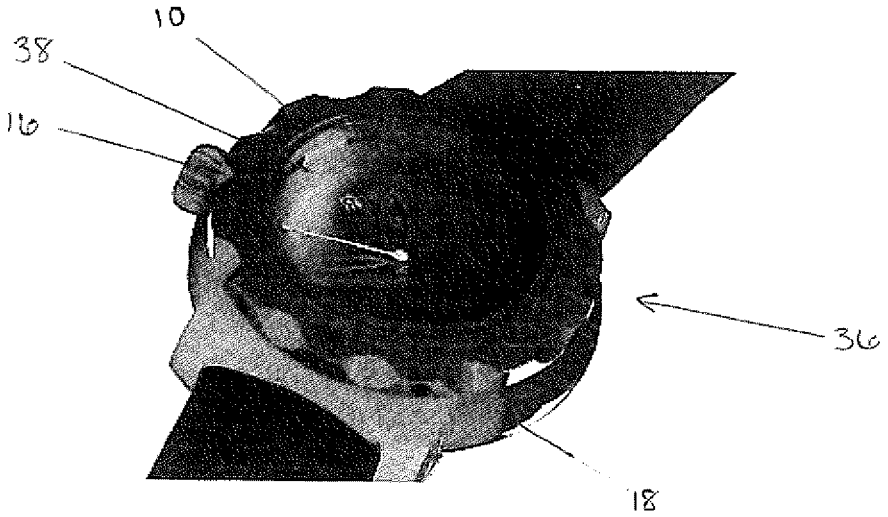
FIG. 1 is a perspective view of a bezel assembly, in accordance with one embodiment of the present invention, shown in use with a wristwatch.

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

FIGS. 1-17 together, a watch bezel assembly 100, 200, 300 of the present invention. In its simplest form, the watch bezel assembly 100 comprises a watch bezel 10, 210, 310; a case 18, 218, 318; and a plurality of locking mechanisms 11, 211, 311. Each locking mechanism 11, 211, 311 comprises a ball 28, 228, 328 and a resilient device, such as a spring 30, 230, 330 or a bumper 52, 252, 352, that is positioned within a ramp 22, 222, 322 such that the locking mechanism 11, 211, 311 prevents the bezel 10, 210, 310 from moving in a clockwise direction relative to the case 18, 218, 318.

FIGS. 1-8 shown one embodiment of a watch bezel assembly 100. FIG. 1 shows the watch bezel assembly 100 of the present invention in use with a wristwatch 36. The watch bezel assembly 100 has a bezel 10 that is movably coupled to the case 18. Unlike prior art watches, the bezel 10 is not used to hold the crystal 38 in place. Rather, the crystal 38 may be cemented, welded, or otherwise sealed to the case 18 so that the bezel 10 does not contribute to the water resistance of the wristwatch 36. The bezel 10 of this embodiment (and all other depicted embodiments) is shown to have a circular shape, but it should be clearly understood that substantial benefit may be derived from the bezel 10 having an alternative shape.

The bezel 10 moves independently of the case 18 and moves in only one direction, counter-clockwise, with respect to the case 18. The bezel 10 may have one or more markings 16 printed upon, etched into, coupled to, or integrally formed with its top surface. In this embodiment, the marking 16 is shown in the form of an arrow, however, it should be clearly understood that substantial benefit may also be derived from the use of multiple markings 16. It should also be clearly understood that the markings 16 may have a different appearance, such as lines, numbers (e.g. 1-60), or some other type of indicator that will provide the user with a visual reference so that the user may use the bezel 10 as a timer.

Figure 2:
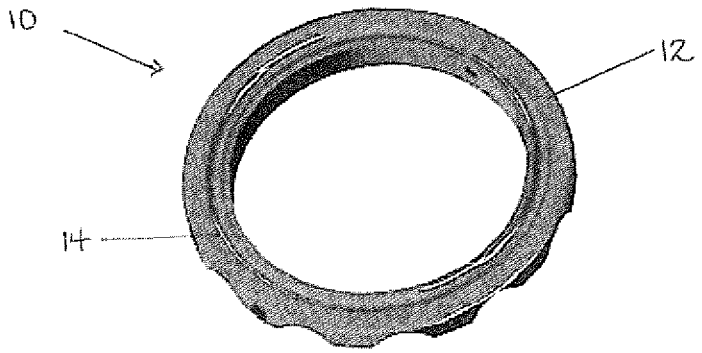
FIG. 2 is a bottom view of the bezel of FIG. 1, shown removed from the case of the wristwatch.

FIG. 2 shows the bottom surface 12 of bezel 10, which has been detached from the case 18. The bezel 10 may have a circular channel 14 formed within its bottom surface 12. The circular channel 14 is adapted to engage a plurality of balls 28 that are positioned between the bezel 10 and the case 18. It should be clearly understood that substantial benefit may be derived from any type of ball bearing or roller bearing being used for the plurality of balls 28.

Figure 3:
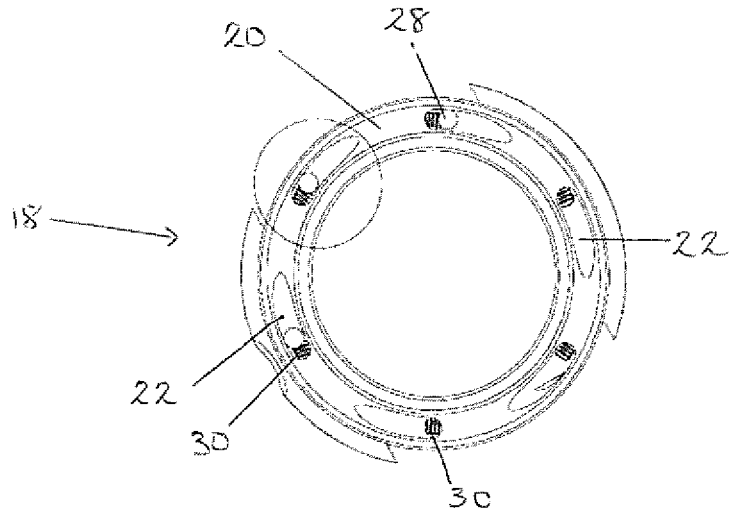
FIG. 3 is a top view of the case of the wristwatch of FIG. 1, shown with the bezel removed.

FIG. 3 shows a top surface 20 of the case 18, where the bezel 10 has been removed. In this embodiment (and the other depicted embodiments), the case 18 is shown to have a circular shape that conforms to the circular shape of the bezel 10, but it should be clearly understood that substantial benefit may be derived from the case 18 having an alternative shape. The top surface 20 of the case 18 may have a plurality of ramps 22 formed therein. The overall shape of the ramps 22 is shown to be curved so that the ramps 22 conform to the circular shape of the case 18. As shown, each ramp 22 may have a semi-circular shaped first end 24 (on the left/counterclockwise end) and a narrower oblong shaped second end 26 (on the right/clockwise end). In this embodiment, the ramps 22 are equally spaced apart from each other.

Figure 4:
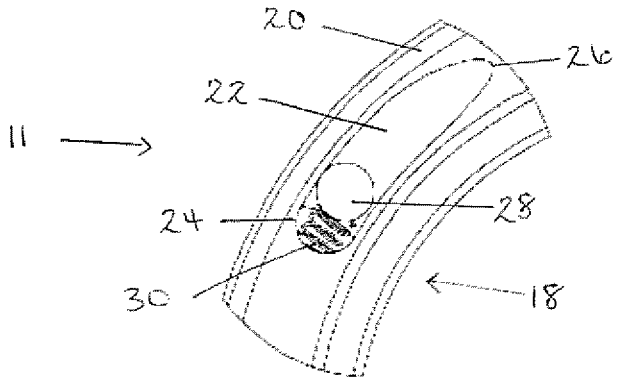
FIG. 4 is a close-up view of a portion of the case of FIG. 3.

As shown in FIG. 4, each ramp 22 is adapted to receive and hold therein a ball 28. In this embodiment, the resilient devices are springs 30. Each ramp 22 also has a spring 30, coupled therein and located proximate the semi-circular shaped first end 24 of the ramp 22. The wound spring 30 may be constructed of any metal, polymer, elastomeric material, or any other type of suitable material that is capable of applying pressure upon the ball 28.

Figure 5:
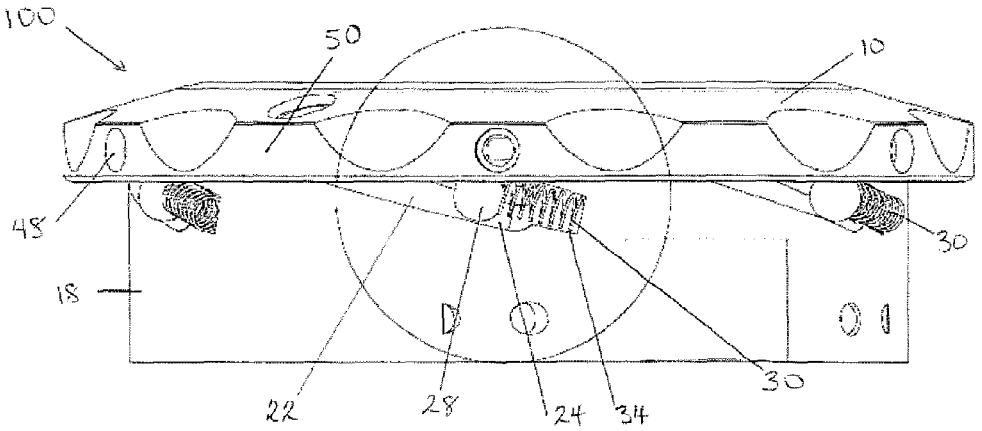
FIG. 5 is a side view of the case and bezel of the wristwatch of FIG. 1, shown with a cross-sectional side view of the case.

FIG. 5 shows a side view of the case 18 and bezel 10 with a cross-sectional side view of the case 18. Each spring 30 has one end that is housed within a cylindrical channel 34 formed within the case 18.

Figure 6:
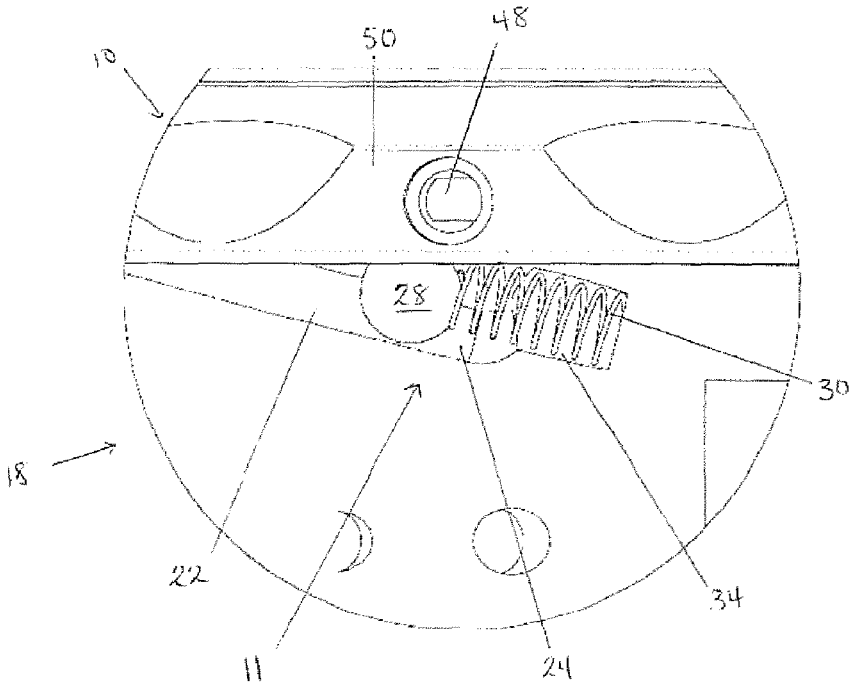
FIG. 6 is a close-up view of a portion of the case and bezel of FIG. 5.

As shown in FIG. 6, each ramp 22 is angled upwardly, so that the semi-circular shaped wide first end 24 of the ramp is positioned lower/deeper within the case 18 than the narrower oblong shaped second end 26 of the ramp 22 (when one is looking downwardly upon the top surface 20 of the case 18). The opening of the channel 34 is in communication with the semi-circular shaped first end 24 of the ramp 22 so that one end of the spring 30 is housed within the cylindrical channel 34 and the other end of the spring 30 is housed within the ramp 22 proximate the semi-circular shaped first end 24.

With this configuration, when the bezel 10 is turned in a counter-clockwise direction relative to the case 18, the ball 28 will travel down the ramp 22 toward the spring 30. The ball 28 will travel without any interference because the bezel 10 travels freely in the counter-clockwise direction. However, when the bezel 10 is turned in a clockwise direction relative to the case 18, the ball 28 will travel up the ramp 22 and will experience instantaneous interference (or a clutching action) caused by the spring 30 which applies/exerts a constant pressure against the ball 28. The spring 30 pushes the ball 28 up the ramp 22 and upwardly against the channel 14 within the bottom surface 12 of the bezel 10. The pressure applied from the spring 30 onto the ball 28 and the pressure applied from the bottom surface 12 of the bezel 10 onto the ball 28 prevents the ball 28 from traveling upwardly on the ramp 22, thereby locking the bezel 10 into place and preventing the bezel 10 from being able to rotate clockwise relative to the case 18.

Figure 7:
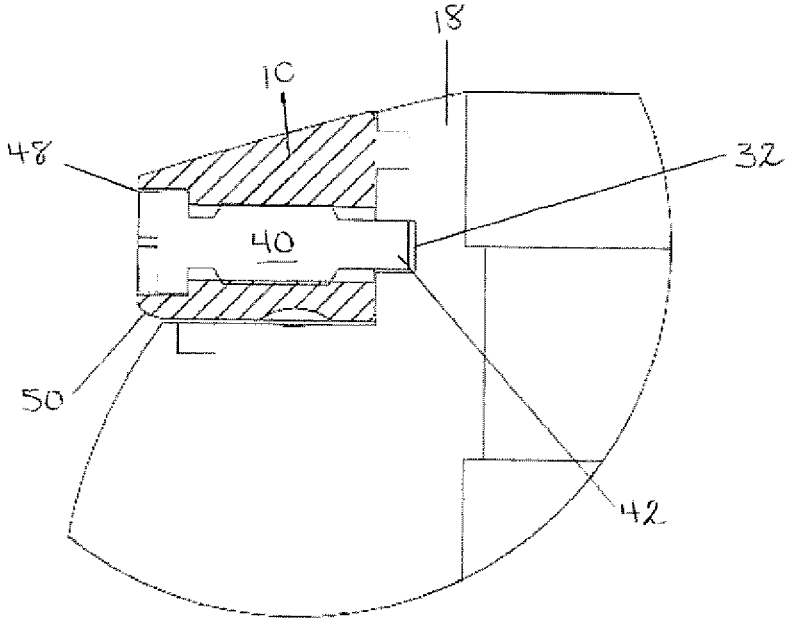
FIG. 7 is a close-up cross-sectional side view of the case and the bezel of the wristwatch of FIG. 1, showing one of the screws that couples the bezel to the case.
Figure 8:
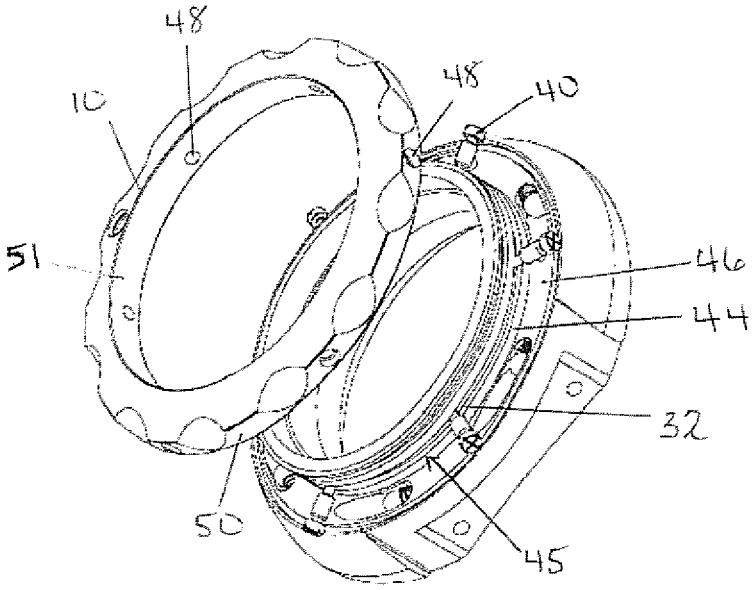
FIG. 8 is an exploded view of the case and bezel of the wristwatch of FIG. 1.

In one embodiment, as shown in FIGS. 7-8, the case 18 may have a cylindrical body 44 extending upwardly/perpendicularly from a base 46 of the case 18. The cylindrical body 44 may have a circular track 32 formed within its outer surface 45. The cylindrical body 44 may also have other threading formed on its outer surface 45. The bezel 10 may be coupled to the cylindrical body 44 of the case 18 by a plurality of screws 40 or any other suitable mechanism. As shown, the screws 40 are inserted through a plurality of corresponding apertures 48 that are formed within the outer surface 50 of the bezel 10 and that pass through to the inner surface 51 of the bezel 10. The screws 40 may each have a rod end 42, wherein once the screws 40 are inserted through the corresponding apertures 48 of the bezel 10, the rod ends 42 of the screws 40 engage the circular track 32 on the outer surface 45 of the cylindrical body 44 of the case 18. When the bezel 10 is turned in a clockwise direction relative to the case 18 and the balls 28 travel up the respective ramps 22, the resilient device, such as a spring 30 or bumper 52, exerts a constant pressure on the balls 28 creating a mechanical locking of the bezel 10 as the ball 28 exerts pressure on the bezel 10 and the bezel 10 is prevented from moving upwards by way of the rod-end screws 40 in the bezel 10. The rod end screws 40 that have been inserted through the apertures 48 of the bezel 10 and into the circular track 32 of the case 18 prevent the bezel 10 from rising up from the case 18 when the balls 28 are pushed up the ramps 22 by the springs 30. By preventing the bezel 10 from rising up from the case 18, the clutching action is maintained.

Figure 9:
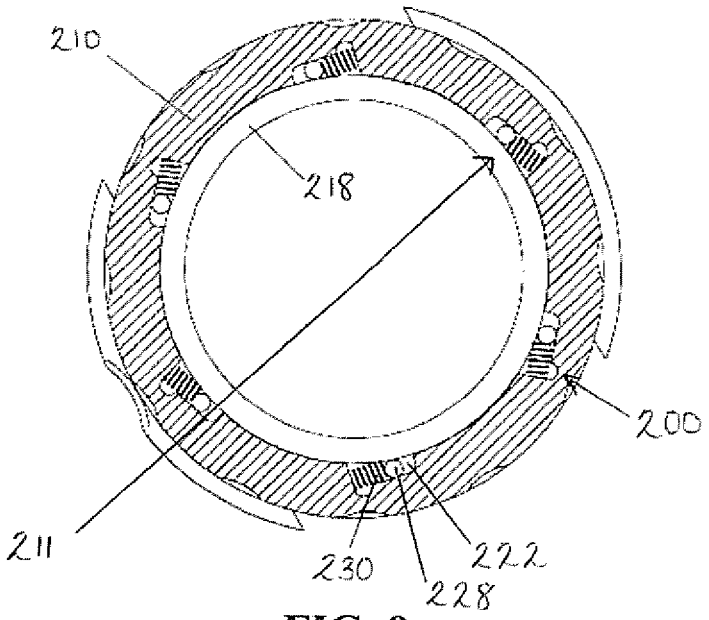
FIG. 9 is a top cross-sectional view of a bezel assembly, in accordance with another embodiment of the present invention.
Figure 10:
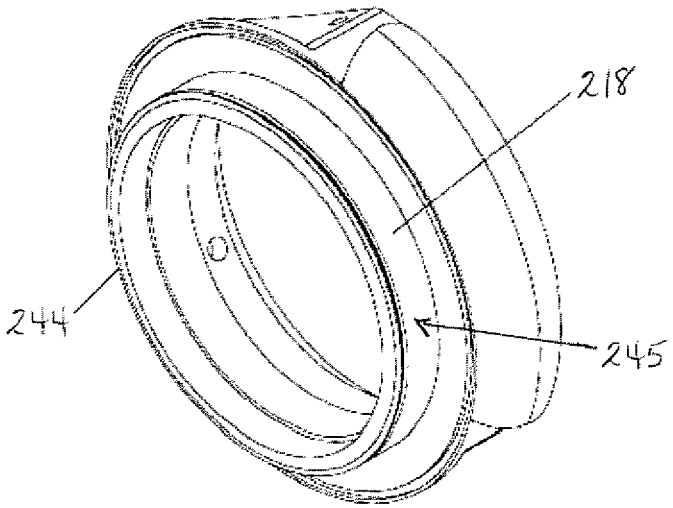
FIG. 10 is a front perspective view of the case of the bezel assembly of FIG. 9.
Figure 11:
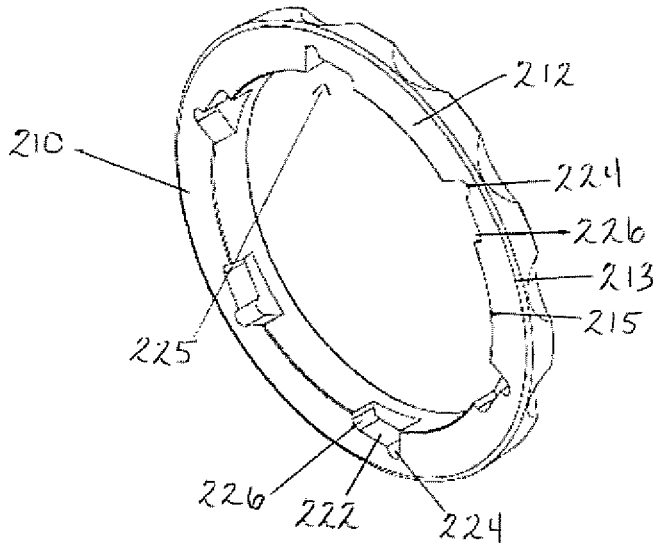
FIG. 11 is a rear perspective view of the bezel of the bezel assembly of FIG. 9.

FIGS. 9-11 show another embodiment of a bezel assembly 200 in accordance with the present invention. In this embodiment, the bezel assembly 200 comprises a bezel 210 and a case 218. The cylindrical body 244 of the case 218 may have a smooth outer surface 245 (i.e. it does not have a track 32 formed within the outer surface 245). Also, in this embodiment, the bottom surface 212 of the bezel 210 may have a plurality of ramps 222 formed therein. In this embodiment, the ramps 222 are equally spaced apart from each other. As shown, each ramp 222 may have a wide first end 224, a narrower second end 226, and an open side portion 225 which is positioned proximate the inner perimeter 215 of the bezel 210.

As shown in FIG. 11, each ramp 222 is angled so that the first end 224 of the ramp 222 is positioned deeper within the bezel 210 (i.e. closer to its outer perimeter 213) than the second end 226 of the ramp 222 (which has a depth that is closer to the inner perimeter of the bezel 210). The open side portion 225 of the ramp 222 is adapted to engage the smooth outer surface 245 of the cylindrical body 244 of the case 218. One end of the resilient device, here shown as a spring 230, is coupled to the first end 224 of the ramp 222 and the other end of the spring 230 is housed within the ramp 222 proximate the second end 226 and is in constant contact with the ball 228.

With this configuration, when the bezel 210 is turned in a counter-clockwise direction relative to the case 218, the ball 228 will travel down the ramp 222 toward the spring 230. The ball 228 will travel without any interference because the bezel 210 travels freely in the counter-clockwise direction. However, when the bezel 210 is turned in a clockwise direction relative to the case 218, the ball 228 will travel up the ramp 222 toward the second end 226 of the ramp 222 and will experience instantaneous interference (or a clutching action) caused by the spring 230 which applies/exerts a constant pressure against the ball 228. The spring 230 pushes the ball 228 up the ramp 222 and inwardly against the outer surface 245 of the cylindrical body 244 of the case 218. The pressure applied from the spring 230 onto the ball 228 and the pressure applied from the cylindrical body 244 of the case 218 onto the ball 228 prevents the ball 228 from traveling upwardly on the ramp 222, thereby locking the bezel 210 into place and preventing the bezel 210 from being able to rotate clockwise relative to the case 218.

Figure 12:
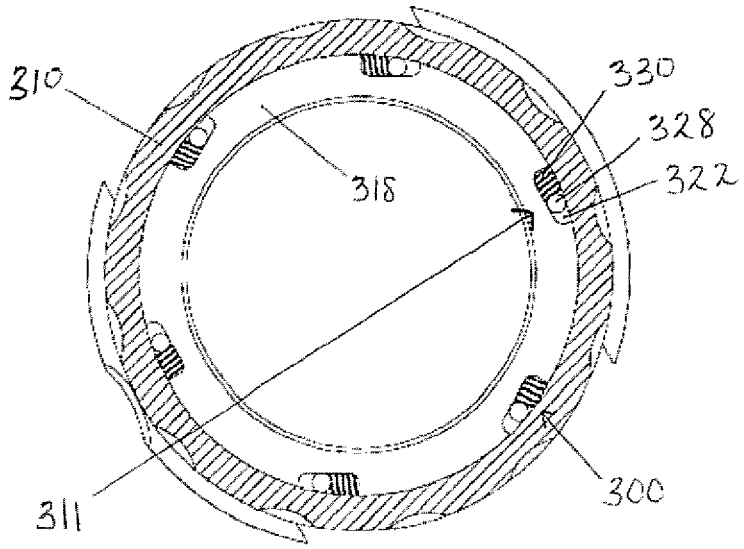
FIG. 12 is a top cross-sectional view of a bezel assembly, in accordance with another embodiment of the present invention.
Figure 13:
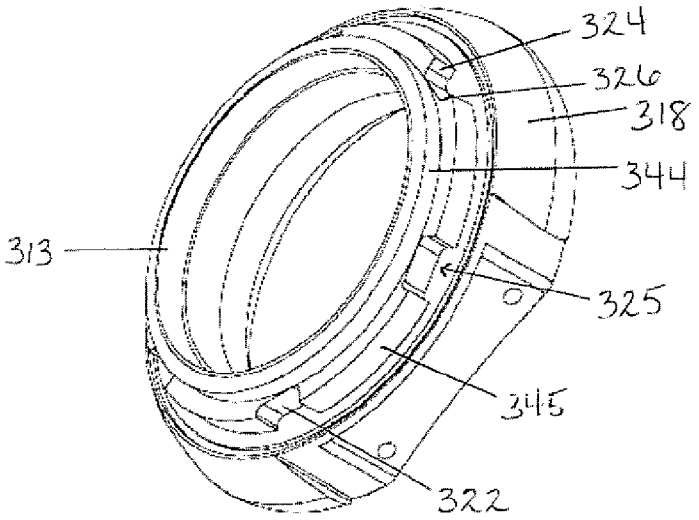
FIG. 13 is a front perspective view of the case of the bezel assembly of FIG. 12.
Figure 14:
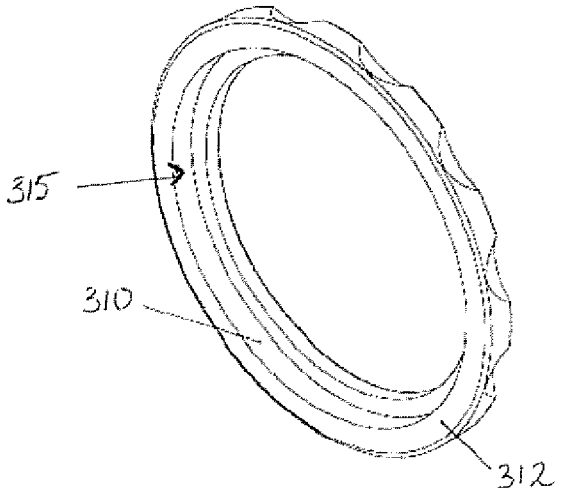
FIG. 14 is a rear perspective view of the bezel of the bezel assembly of FIG. 12.

FIGS. 12-14 show another embodiment of a bezel assembly 300 in accordance with the present invention. In this embodiment, the bezel assembly 300 comprises a bezel 310 and a case 318. The bezel 310 may have a smooth inner surface 315 as shown in FIG. 14. Also, in this embodiment, the outer surface 345 of the cylindrical body 344 of the case 318 may have a plurality of ramps 322 formed therein. In this embodiment, the ramps 322 are equally spaced apart from each other. As shown, each ramp 322 may have a wide first end 324, a narrower second end 326, and an open side portion 325 which is positioned on the outer surface 345 of the cylindrical body 344.

As shown in FIGS. 12 and 13, each ramp 322 is angled so that the first end 324 of the ramp 322 is positioned deeper within the cylindrical body 344 (i.e. closer to its inner perimeter 313) than the second end 326 of the ramp 322 (which has a depth that is closer to the outer surface 345 of the cylindrical body 344). The open side portion 325 of the ramp 322 is adapted to engage the smooth inner surface 315 of the bezel 310. One end of the resilient device, here shown as a spring 330, is coupled to the first end 324 of the ramp 322 and the other end of the spring 330 is housed within the ramp 322 proximate the second end 326 and is in constant contact with the ball 328.

With this configuration, when the bezel 310 is turned in a counter-clockwise direction relative to the case 318, the ball 328 will travel down the ramp 322 toward the spring 330. The ball 328 will travel without any interference because the bezel 310 travels freely in the counter-clockwise direction. However, when the bezel 310 is turned in a clockwise direction relative to the case 318, the ball 328 will travel up the ramp 322 toward the second end 326 of the ramp 322 and will experience instantaneous interference (or a clutching action) caused by the spring 330 which applies/exerts a constant pressure against the ball 228. The spring 330 pushes the ball 328 up the ramp 322 and outwardly against the inner surface 315 of the bezel 310. The pressure applied from the spring 330 onto the ball 238 and the pressure applied from the inner surface 315 of the bezel 310 onto the ball 328 prevents the ball 328 from traveling upwardly on the ramp 322, thereby locking the bezel 310 into place and preventing the bezel 310 from being able to rotate clockwise relative to the case 318.

Figure 15:
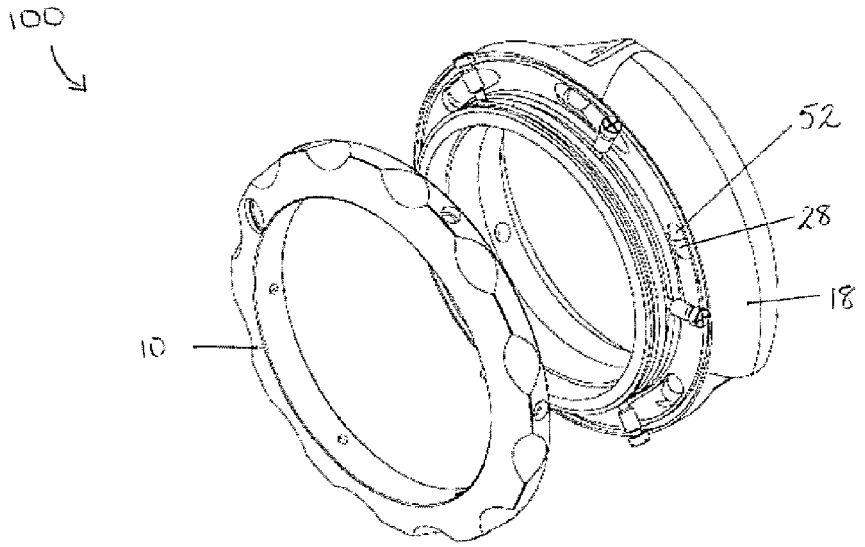
FIG. 15 is a front exploded perspective view of the bezel assembly of FIG. 1, shown using bumpers as the resilient devices.
Figure 16:
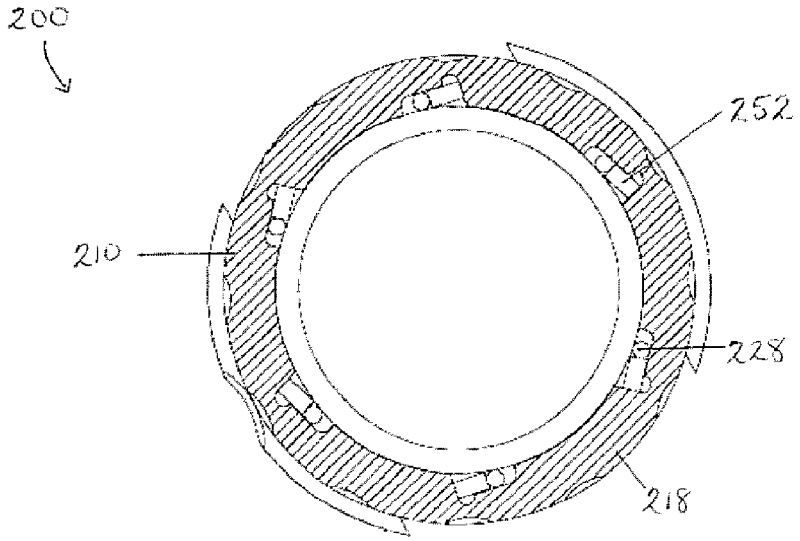
FIG. 16 is a top cross-sectional view of the bezel assembly of FIG. 9, shown using bumpers as the resilient devices.
Figure 17:
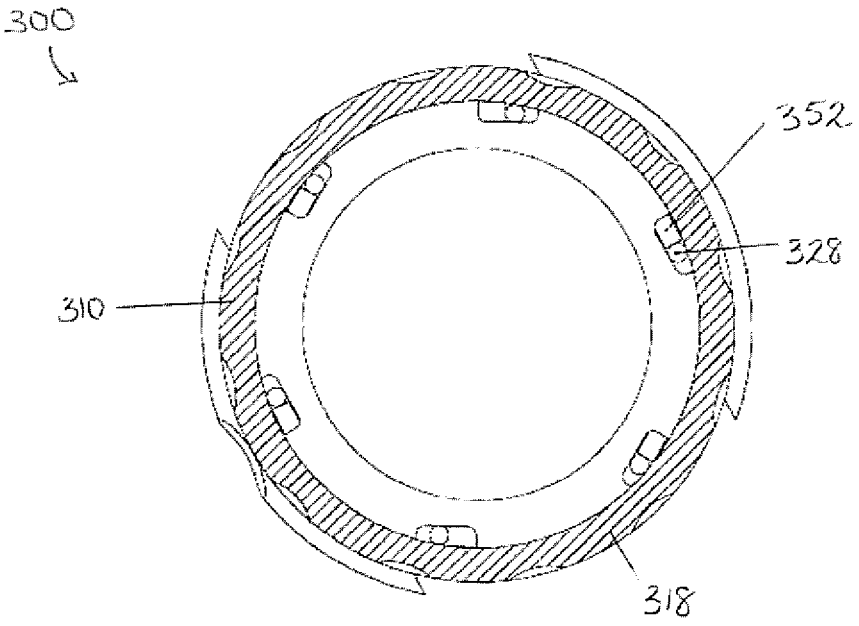
FIG. 17 is a top cross-sectional view of the bezel assembly of FIG. 12, shown using bumpers as the resilient devices.

Referring to FIGS. 15-17, the resilient devices of the bezel assembly 100 are bumpers 52, 252, 352 rather than springs 30, 230, 330. The bumpers 52, 252, 352 may be constructed of any polymer, elastomeric material, or any other type of suitable resilient material that is capable of applying pressure upon the ball 28, 228, 328. FIG. 15 shows bumpers 52 used in the bezel assembly 100 instead of springs 30; FIG. 16 shows bumpers 252 used in the bezel assembly 200 instead of springs 230; and FIG. 17 shows bumpers 352 used in the bezel assembly 300 instead of springs 330. The bumpers 52, 252, 352, like the springs 30, 230, 330, should be sized to fit within the ramps 22, 222, 322 and may be constructed of any suitable material that is sufficiently resilient and/or elastic to apply the pressure upon the ball 28, 228, 328 in the same fashion as the springs 30, 230, 330.

The foregoing description is illustrative of particular embodiments of the application, but is not meant to be limitation upon the practice thereof. While embodiments of the disclosure have been described in terms of various specific embodiments, those skilled in the art will recognize that the embodiments of the disclosure may be practiced with modifications within the spirit and scope of the claims.

What is claimed is:

1. A bezel assembly for a watch comprising:
a case;
a bezel adapted to be coupled to the case; and
a plurality of locking mechanisms between the case and the bezel, wherein each locking mechanism comprises:
a ramp;
a ball contained within the ramp; and
a resilient device positioned within the ramp;

wherein the resilient device exerts a constant pressure upon the ball to prevent the bezel from moving in a clockwise direction relative to the case.

2. The bezel assembly of claim 1 wherein the plurality of locking mechanisms comprise:

a plurality of ramps formed within a top surface of the case;

a plurality of balls, each ball contained within one of the plurality of ramps; and a plurality of resilient devices, wherein a single resilient device is positioned within one of the plurality of ramps;

wherein the single resilient device within the ramp exerts a constant upward pressure on the ball contained within the ramp toward the bezel.

3. The bezel assembly of claim 2 further comprising a circular channel formed within a bottom surface of the bezel, wherein the circular channel is adapted to engage the plurality of balls contained within the plurality of ramps.

4. The bezel assembly of claim 2 wherein each ramp has a first end and a second and wherein each ramp is angled upwardly so that the first end of the ramp is positioned lower within the case than the second end of the ramp.

5. The bezel assembly of claim 4 wherein the single resilient device within the ramp has one end housed within a cylindrical channel that is formed within the case and that is in communication with the first end of the ramp and wherein the single resilient device within the ramp has another end that is housed within the ramp proximate the first end of the ramp.

6. The bezel assembly of claim 2 wherein the plurality of resilient devices apply constant pressure upon the balls upwardly against the circular channel within the bottom surface of the bezel, thereby preventing the bezel from moving in the clockwise direction.

7. The bezel assembly of claim 2 wherein the case further comprises:

a base;

a cylindrical body extending upwardly from the base; and a circular track formed within an outer surface of the cylindrical body.

8. The bezel assembly of claim 7 wherein the bezel further comprises:

a plurality of apertures formed within an outer surface of the bezel and that pass through to an inner surface of the bezel; and a plurality of screws, each screw having a rod end that is adapted to be inserted through one of the apertures of the bezel and to engage the circular track formed within the outer surface of the cylindrical body.

9. The bezel assembly of claim 1 wherein the case further comprises:

a base; and a cylindrical body extending upwardly from the base; and wherein the plurality of locking mechanisms comprise:

a plurality of ramps formed within a bottom surface of the bezel;

a plurality of balls, each ball contained within one of the plurality of ramps; and a plurality of resilient devices, wherein a single resilient device is positioned within one of the plurality of ramps;

wherein the single resilient device within the ramp exerts a constant inward pressure on the ball contained within the ramp toward an outer surface of the cylindrical body of the case, thereby preventing the bezel from moving in the clockwise direction.

10. The bezel assembly of claim 9 wherein each ramp has a first end and a second and wherein each ramp is angled so that the first end of the ramp is positioned closer to an outer perimeter of the bezel than the second end of the ramp.

11. The bezel assembly of claim 10 wherein the single resilient device within the ramp has one end coupled to the first end of the ramp and wherein the single resilient device within the ramp has another end that is housed within the ramp proximate the second end of the ramp.

12. The bezel assembly of claim 9 wherein the outer surface of the cylindrical body is smooth and is adapted to engage the plurality of balls contained within the plurality of ramps.

13. The bezel assembly of claim 1 wherein the case further comprises:

a base; and a cylindrical body extending upwardly from the base; and wherein the plurality of locking mechanisms comprise:

a plurality of ramps formed within an outer surface of the cylindrical body of the case;

a plurality of balls, each ball contained within one of the plurality of ramps; and a plurality of resilient devices, wherein a single resilient device is positioned within one of the plurality of ramps;

wherein the single resilient device within the ramp exerts a constant outward pressure on the ball contained within the ramp toward an inner surface of the bezel, thereby preventing the bezel from moving in the clockwise direction.

14. The bezel assembly of claim 13 wherein each ramp has a first end and a second and wherein each ramp is angled so that the first end of the ramp is positioned closer to an inner perimeter of the cylindrical body of the case.

15. The bezel assembly of claim 14 wherein the single resilient device within the ramp has one end coupled to the first end of the ramp and wherein the single resilient device within the ramp has another end that is housed within the ramp proximate the second end of the ramp.

16. A bezel assembly for a watch comprising:

a case, wherein the case comprises:

a base; and a cylindrical body extending upwardly from the base;

a bezel adapted to be coupled to the case; and a plurality of locking mechanisms between the case and the bezel, wherein each locking mechanism comprises:

a ramp having a first end and a second end;

a ball contained within the ramp; and one of a spring and a bumper positioned within the ramp and coupled to the first end of the ramp;

wherein the one of the spring and the bumper exerts a constant pressure upon the ball to prevent the bezel from moving in a clockwise direction relative to the case.

17. The bezel assembly of claim 16 wherein the ramp is formed within a top surface of the case, the ball is contained within the ramp, and the one of the spring and the bumper is positioned within the ramp and wherein the one of the spring and the bumper exerts a constant upward pressure on the ball contained within the ramp toward a bottom surface of the bezel, thereby preventing the bezel from moving in the clockwise direction.

18. The bezel assembly of claim 16 wherein the ramp is formed within a bottom surface of the bezel, the ball is contained within the ramp, and the one of the spring and the bumper is positioned within the ramp and wherein the one of the spring and the bumper exerts a constant inward pressure on the ball contained within the ramp toward an outer surface of the cylindrical body of the case, thereby preventing the bezel from moving in the clockwise direction.

19. The bezel assembly of claim 16 wherein the ramp is formed within an outer surface of the cylindrical body of the case, the ball is contained within the ramp, and the one of the spring and the bumper is positioned within the ramp and wherein the one of the spring and the bumper exerts a constant outward pressure on the ball contained within the ramp toward an inner surface of the bezel, thereby preventing the bezel from moving in the clockwise direction.

20. A bezel assembly for a watch comprising:

a case, wherein the case comprises:

a base;

a cylindrical body extending upwardly from the base; and a cylindrical track formed within an outer surface of the cylindrical body;

a bezel adapted to be coupled to the case, wherein the bezel comprises:

a plurality of apertures formed within an outer surface of the bezel and that pass through to an inner surface of the bezel; and a plurality of screws, each screw having a rod end that is adapted to be inserted through one of the apertures of the bezel and to engage the circular track formed within the outer surface of the cylindrical body; and a plurality of locking mechanisms between the case and the bezel, wherein each locking mechanism comprises:

a ramp having a first end and a second end;

a ball contained within the ramp; and one of a spring and a bumper positioned within the ramp and coupled to the first end of the ramp;

wherein the one of the spring and the bumper exerts a constant pressure upon the ball to prevent the bezel from moving in a clockwise direction relative to the case while the screws prevent the bezel from moving upwards.

* * * * *